US010650708B2

(12) United States Patent
Thode

(10) Patent No.: US 10,650,708 B2
(45) Date of Patent: May 12, 2020

(54) SYSTEM FOR SECURING A SIGN TO A SUPPORT SURFACE

(71) Applicant: Dania Technology ApS, Odense SV (DK)

(72) Inventor: Ken Thode, Odense SV (DK)

(73) Assignee: Dania Technology ApS, Odense SV (DK)

( * ) Notice: Subject to any disclaimer, the term of this patent is extended or adjusted under 35 U.S.C. 154(b) by 0 days.

(21) Appl. No.: 16/395,866

(22) Filed: Apr. 26, 2019

(65) Prior Publication Data

US 2019/0318668 A1 Oct. 17, 2019

Related U.S. Application Data

(63) Continuation of application No. PCT/DK2017/050352, filed on Oct. 27, 2017.

(30) Foreign Application Priority Data

Oct. 28, 2016 (DK) ..... 2016 70851

(51) Int. Cl.
*G09F 7/04* (2006.01)
*G09F 7/18* (2006.01)
*G09F 7/10* (2006.01)

(52) U.S. Cl.
CPC ..... *G09F 7/04* (2013.01); *G09F 7/10* (2013.01); *G09F 7/18* (2013.01); *G09F 2007/1852* (2013.01)

(58) Field of Classification Search
CPC ..... G09F 9/375; G09F 2007/1852
USPC ..... 40/611.07, 611.11
See application file for complete search history.

(56) References Cited

U.S. PATENT DOCUMENTS 3,744,833 A * 7/1973 Berducone ..... E05B 47/0038 292/251.5
4,184,277 A 1/1980 Larin
4,780,978 A 11/1988 Sonderbaek
5,485,733 A * 1/1996 Hoffman ..... E05B 47/004 70/276
5,608,980 A * 3/1997 Pangerl ..... G09F 15/0018 292/251.5
8,627,588 B2 * 1/2014 Rosander ..... G09F 3/204 340/5.91
2012/0023797 A1 2/2012 Rosander et al.

FOREIGN PATENT DOCUMENTS

EP 2230655 A1 9/2010

OTHER PUBLICATIONS

International Search Report and Written Opinion from International Application No. PCT/DK2017/050352, dated Jan. 15, 2018.

* cited by examiner

*Primary Examiner* — Joanne Silbermann
(74) *Attorney, Agent, or Firm* — Merchant & Gould P.C.

(57) ABSTRACT

There is provided a system for securing a sign to a support surface. The system comprises a magnetically releasable lock adapted to automatically lock mutually displaceable surface portions together. The system ensures locking of the two mutually displaceable portions without the visible information-carrying part being disfigured. Unauthorized persons cannot remove the information-carrying part without having knowledge about the location of the magnetically releasable lock.

10 Claims, 3 Drawing Sheets

SYSTEM FOR SECURING A SIGN TO A SUPPORT SURFACE

This application is a Continuation of International Application No. PCT/DK2017/050352, filed 27 Oct. 2017, which claims benefit of Serial No. PA 2016 70851, filed 28 Oct. 2016 in Denmark and which applications are incorporated herein by reference. To the extent appropriate, a claim of priority is made to each of the above disclosed applications.

FIELD OF THE INVENTION

The present invention relates to a system for securing a sign to a support surface. More specifically the invention relates to a system comprising a magnetically releasable lock adapted to automatically lock mutually displaceable surface portions together.

BACKGROUND OF THE INVENTION

Signs, name plates and the like often need to be mounted on a base secured to a door or wall. These are prone to be subjected to unwarranted removal. This is particularly so with name plates which can readily be used by others. The unauthorized removal of name plates has led to considerable inconvenience and expense in providing replacements.

Various sign devices of the above type are known. Such signs are used both as permanent signs and as signs, where the user according to his wishes can replace the information-carrying part with another information-carrying part. These sign devices are generally used without any locking of the information-carrying part in relation to the mounting part, for which reason unauthorized persons can easily remove the information-carrying part. Different methods have consequently been used for locking the two parts together, but the previously known methods have not proved fully satisfactory, either because the information-carrying part has been disfigured by visible screws or because unauthorized persons have nevertheless been able to release the fastening mechanism concerned.

It is therefore an object of the present invention to provide a system for securing a sign to a support surface, wherein the sign can be readily secured and which is not prone to unauthorized removal.

The object of the invention is to provide a system in which the locking means is not visible and an external magnetic device suitably designed must be applied to a predetermined area of the assembly in order to remove the sign-carrying part from its base.

A further object of the invention is to provide a system in which a sign-carrying part will automatically lock itself when repositioned on the base of the name plate assembly.

US2012023797 describes a system for securing a sign to a support surface. The system has a sign-carrying part for releasable attachment on a mounting part. The system of US2012023797 uses a spring loaded element is arranged such that the spring loaded element, in a latched position, secures the sign-carrying part for releasable attachment on the mounting part when gripping means is brought into a hooked position in receiving means. When displaced from its latched position, allowing the gripping means to leave its hooked position, this enables removal of the sign-carrying part from the mounting part.

The present invention seeks an alternative magnetic lock for a securing a sign to a support surface.

SUMMARY OF THE INVENTION

The system according to the invention is characterized in that the sign device comprises a magnetically releasable lock adapted to automatically lock mutually displaceable surface portions together. The system ensures locking of the two mutually displaceable portions without the visible information-carrying part being disfigured. Unauthorized persons cannot remove the information-carrying part without having knowledge about the location of the magnetically releasable lock.

Specifically the present invention provides a system for securing a sign to a support surface, said system comprising:

a sign-carrying part for releasable attachment on a mounting part, said sign-carrying part having a front side for holding the sign and a back side provided with a track that loosely holds a locking plate, said track providing a compartment for the locking plate with an opening distal to the back side of the sign-carrying part, said locking plate provided with a protrusion that protrudes beyond the opening of the track when the locking plate is resting on the inner surface of the track distal to the back side;

a mounting part configured to be fixedly attached to a support surface, said mounting part having a backside for mounting it on the support surface, and a front side with a track for receiving the protrusion of the locking plate thereby preventing lateral displacement/movement of the sign-carrying part;

wherein the mounting part and the sign-carrying part further comprise mutually cooperating profile portions, said locking plate being magnetic and in an a locking position when not being influenced by an external magnetic force from the front side of the sign that is greater than the magnetic force between the locking plate and a part of the front side of the mounting part, said locking plate being in an open position when influenced by said external magnetic force thereby allowing the sign-carrying part to be released from said mounting part.

Preferably the track of the mounting part includes a magnetic piece for exerting the magnetic force between the locking plate and a part of the front side of the mounting part. The sign-carrying part and/or the mounting part are preferably produced from a non-magnetic material, such as aluminum.

In a preferred embodiment of the present invention the mutually cooperating profile portions are located in the peripheral region of the sign-carrying part and the mounting part. Accordingly, the tracks of the sign-carrying part and the mounting part are located in the central regions thereof.

In a particularly preferred embodiment the cross section of the track of the sign-carrying part takes the form of a quadratic tunnel closed in the ends and with a longitudinal opening in the roof section of said tunnel to ensure that the locking plate is slidable in the tunnel between said ends, and wherein the track for receiving the protrusion of the locking plate is aligned and parallel with the longitudinal opening. Preferably the roof section is in contact with the uppers section of the track of the mounting part when the system is assembled. It is also preferred that the opening of the perfectly fits the protrusion of the opening of the track of the sign-carrying part. Likewise, the protrusion of the locking plate is preferably of quadratic shape, whereas the locking plate is of a rectangular shape.

The system of the present invention comprises a sign or name plate mounted on a base together with magnet means whereby the name plate is secured to the base and is releasable from the base only when the magnet means is made operable by an authorized person. While the magnet within the sign or name plate assembly is in the unlocked position, the sign-carrying part can be wristed out of engagement with the mounting part. Without the use of an operative magnet, the part remains securely locked.

In some applications of the invention where an electrical supply is available, such as for illuminating a directory panel board, electro-magnets can be employed for locking and unlocking the parts.

The present invention, therefore, provides a relatively cheap and practical means of protecting signs and name plates from unwarranted removal from the base on which they are mounted.

DETAILED DESCRIPTION OF THE INVENTION

Figure 1:
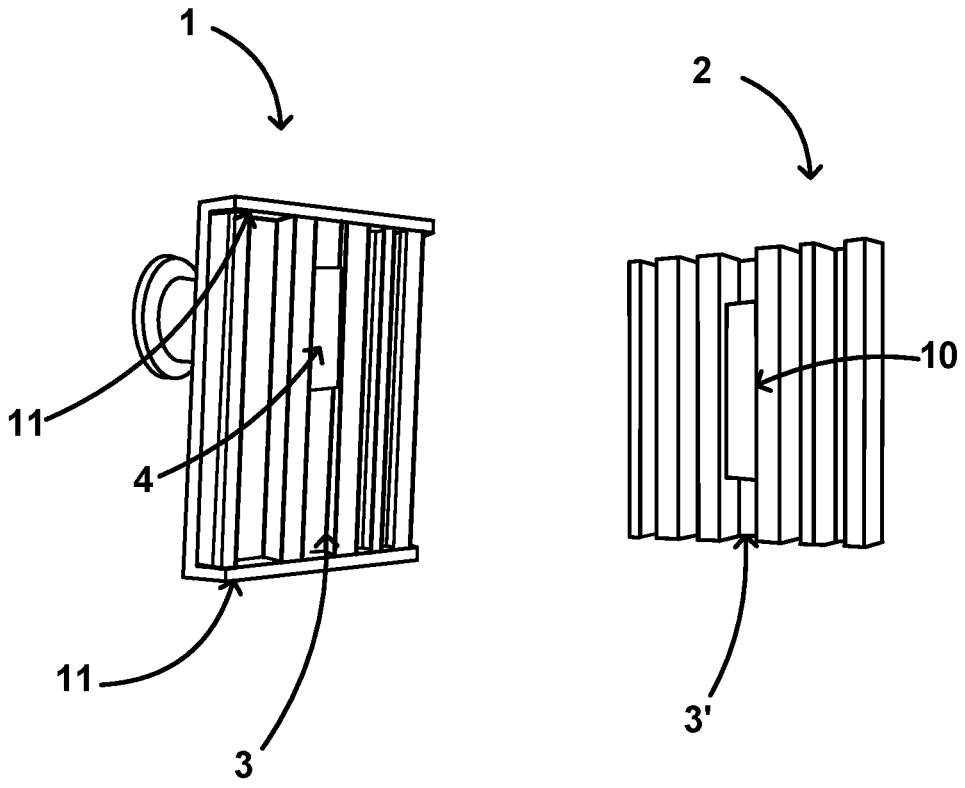
FIG. 1 is a part perspective view of a system according to the present invention with the sign-carrying part removed from the mounting part.
Figure 2:
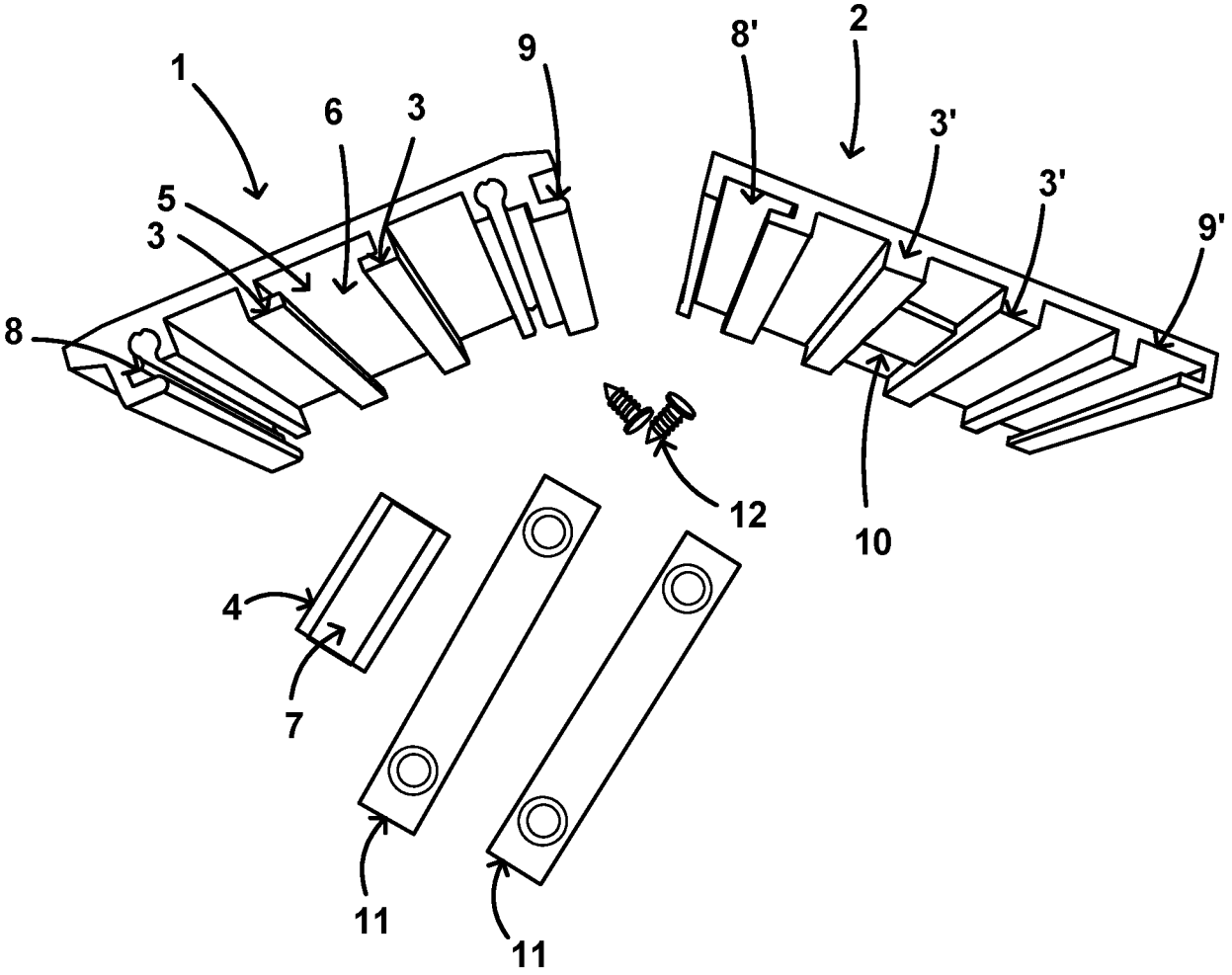
FIG. 2 is a part perspective view of the system of FIG. 2, which has been disassembled.

The system illustrated in FIGS. 1-2 comprises a sign-carrying part (1) for releasable attachment on a mounting part (2), said sign-carrying part (1) having a front side for holding the sign and a back side provided with a track (3) that loosely holds a locking plate (4), said track providing a compartment (5) for the locking plate (4) with an opening (6) distal to the back side of the sign-carrying part, said locking plate (4) provided with a protrusion (7) that protrudes beyond the opening (6) of the track (3) when the locking plate is resting on the inner surface of the track (3) distal to the back side. The mounting part (2) configured to be fixedly attached to a support surface, said mounting part (2) having a backside for mounting it on the support surface, and a front side with a track (3') for receiving the protrusion (7) of the locking plate (4) thereby preventing lateral displacement/movement of the sign-carrying part (1).

Figure 3A:
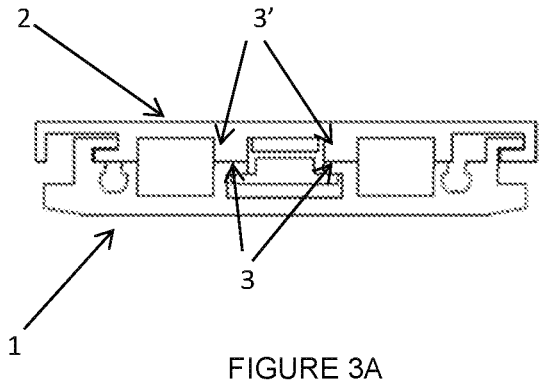
FIGS. 3A and 3B shows cross-sectional views of the mounting parts of FIGS. 1 and 2.
Figure 3B:
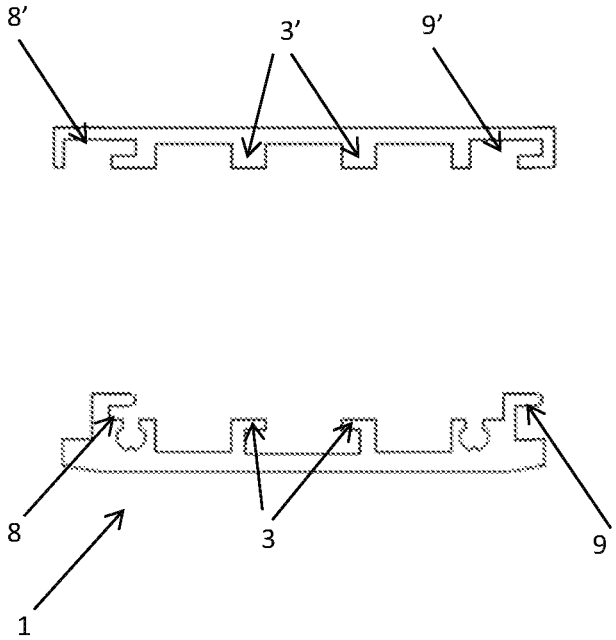

As shown in FIGS. 1-3 the mounting part (2) and the sign-carrying part (1) further comprise mutually cooperating profile portions (8, 8', 9, 9'), said locking plate (4) being magnetic and in an a locking position when not being influenced by an external magnetic force from the front side of the sign that is greater than the magnetic force between the locking plate (4) and a part (10) of the front side of the mounting part. Importantly the locking plate (4) being in an open position when influenced by said external magnetic force thereby allowing the sign-carrying part (1) to be released from said mounting part (2). FIG. 2 further shows end caps (11) and screws (12) for fastening these to the ends of the mounting part (2) and the sign-carrying part (1) in order to prevent that the parts may slide longitudinally relative to each other. FIGS. 3A and 3B shows cross-sectional views of the mounting parts of FIGS. 1 and 2.

The sign-carrying part (1) may further comprise an information-carrying part in the form of a rail. The mounting part (2) and the sign-carrying part (1) are preferably of the same length.

The invention claimed is:

1. A system for securing a sign to a support surface, said system comprising:

a sign-carrying part for releasable attachment on a mounting part, said sign-carrying part having a front side for holding the sign and a back side provided with a track that loosely holds a locking plate, said track providing a compartment for the locking plate with an opening distal to the back side of the sign-carrying part, said locking plate provided with a protrusion that protrudes beyond the opening of the track when the locking plate is resting on the inner surface of the track distal to the back side;

the mounting part configured to be fixedly attached to a support surface, said mounting part having a backside for mounting it on the support surface, and a front side with a track for receiving the protrusion of the locking plate thereby preventing lateral displacement/movement transversally in relation to the track of the sign-carrying part;

wherein the mounting part and the sign-carrying part further comprise mutually cooperating profile portions, said locking plate being magnetic and in an a locking position when not being influenced by an external magnetic force from the front side of the sign that is greater than the magnetic force between the locking plate and a part of the front side of the mounting part, said locking plate being in an open position when influenced by said external magnetic force thereby allowing the sign-carrying part to be released from said mounting part.

2. The system according to claim 1, wherein the track of the mounting part includes a magnetic piece for exerting the magnetic force between the locking plate and a part of the front side of the mounting part.

3. The system according to claim 1, wherein the sign-carrying part and/or the mounting part are produced from a non-magnetic material, such as aluminum.

4. The system according to claim 1, wherein the mutually cooperating profile portions are located in the peripheral region of the sign-carrying part and the mounting part.

5. The system according to claim 1, wherein the tracks of the sign-carrying part and the mounting part are located in the central regions thereof.

6. The system according to claim 1, wherein the cross section of the track of the sign carrying part takes the form of a quadratic tunnel closed in the ends and with a longitudinal opening in the roof section of said tunnel to ensure that the locking plate is slidable in the tunnel between said ends, and wherein the track for receiving the protrusion of the locking plate is aligned and parallel with the longitudinal opening.

7. The system according to claim 6, wherein the roof section is in contact with the upper section of the track of the mounting part when the system is assembled.

8. The system according to claim 1, wherein the openings of the tracks perfectly fits the protrusion of the locking plate.

9. The system according to claim 1, wherein the protrusion of the locking plate is quadratic.

10. The system according to claim 1, wherein the locking plate is of a rectangular shape.

* * * * *